United States Patent [19]

Clark et al.

[11] Patent Number: 4,971,624

[45] Date of Patent: Nov. 20, 1990

[54] ABRASION AND EROSION RESISTANT ARTICLES

[76] Inventors: Eugene V. Clark, 19801 Gresham, Northridge, Calif. 91324; George K. Sievers, 1110 Kenwood St., Burbank, Calif. 91505

[21] Appl. No.: 289,228

[22] Filed: Dec. 22, 1988

Related U.S. Application Data

[60] Continuation of Ser. No. 494,541, May 13, 1983, abandoned, which is a division of Ser. No. 351,341, Feb. 2, 1982, Pat. No. 4,402,764, which is a continuation-in-part of Ser. No. 240,861, Mar. 5, 1981, abandoned.

[51] Int. Cl.[5] ..... C22C 29/04

[52] U.S. Cl. ..... 75/238; 75/244; 427/227; 428/547; 428/610; 428/627

[58] Field of Search ..... 75/238, 244; 427/227; 428/547, 610, 627

[56] References Cited

U.S. PATENT DOCUMENTS

| | | | |
|---|---|---|---|
| 3,929,476 | 12/1975 | Kirby, Jr. et al. | 75/214 |
| 4,146,080 | 3/1979 | Baum | 164/97 |
| 4,402,764 | 9/1983 | Clark et al. | 148/247 |
| 4,699,839 | 10/1987 | Hornberger | 428/312.8 |

*Primary Examiner*—Stephen J. Lechert, Jr.
*Assistant Examiner*—Nina Bhat
*Attorney, Agent, or Firm*—Louis J. Bachand

[57] ABSTRACT

Erosion and abrasion resistant refractory metal carbide articles are provided having multiphase alloy of borides including titanium boride, binder metal boride, and titanium-binder metal-refractory metal borides by diffusion of titanium initially to convert the refractory metal carbide to its constitutents which are then reacted with boron, forming a new added surface in replacement of the original article surface, and bridging the original surface locus.

12 Claims, No Drawings

ABRASION AND EROSION RESISTANT ARTICLES

REFERENCE TO RELATED APPLICATION

This application is a continuation, of application Ser. No. 06/494,541, filed May 13, 1983, which is a division of Ser. No. 351,341, filed Feb. 26, 1982, now U.S. Pat. No. 4,402,764 which is a continuation in part of Ser. No. 240,861, filed Mar. 5, 1981, now abandoned, the disclosures of which are incorporated herein by this reference.

This application is a continuation in part of our earlier filed application, Ser. No. 6-240861, filed Mar. 5, 1981, which application is hereby incorporated herein.

TECHNICAL FIELD

This invention has to do with very hard, highly wear resistant, i.e. abrasion and erosion resistant formed articles, and more particularly with reformed surfaces on such articles whereby the articles are extremely resistant to erosion and abrasion by high pressure, particulate-laden fluid streams, such as are frequently encountered in various mineral recovery industries, e.g. oil field fluids and coal processing slurries.

For such applications, all manner of fluid handling equipment is required, and much of it must maintain close tolerances despite being used to channel, throttle or otherwise control abrasive fluid streams which by their nature erode and abrade all surfaces with which they come in contact. Such equipment includes, for example, choke valves, both fixed and variable, pump housings, pump impellers, valves, valve plugs, valve bodies and seats, extrusion, spray and injection nozzles, and piping of all kinds, particularly where such are anticipated to be subjected to flows of erosive fluids, drill bits and coal cutting apparatus, and parts thereof, all of which equipments are collectively referred to herein as "formed articles".

The invention is specifically concerned with practical means of obtaining the long sought hardness and wear resistance benefits of very hard alloys such as titanium diboride on a wide variety of fabricated parts, especially those formed of refractory metal carbides, e.g. tungsten carbides, as well as tantalum, titanium or zirconium carbides, cast or sintered with a binder metal as necessary, for example, small amounts of nickel, cobalt, chromium, or iron as a matrix for the carbide. It has been found that mere hardness is not sufficient to resist abrasion and erosion. Spalling, e.g. of titanium diboride, manifested by the loss of flakes of the very hard coating occurs where the hard coating is merely formed on the article surface, must be prevented, or the benefits of the hard surface is lost.

BACKGROUND ART

Titanium diboride is a known to be an extremely hard material, having a hardness typically in excess of $4\times10^3$ Knoop Hardness Number (KHN) and is known to be a coating on refractory metal carbides.

Chemical vapor deposition to obtain titanium diboride has limited utility because of part configuration constraints. Different coefficients of thermal expansion from titanium diboride vapor deposited coating of most potential substrates limits the number and type of base materials severely, e.g. to tungsten carbide and graphite. Moreover, because chemical vapor deposition depends of fluid streams passing over the part surface being treated, the result is subject to discontinuities where flow patterns are undesirable, variations reflecting varying flow patterns, and withal an inability to develop an effective deposit in many areas of complex parts.

The commercial application of titanium diboride to refractory metal carbides has thus not been practically achievable. Nor therefore, have the benefits of this extremely hard, long wearing and erosion resistant composition been available on a wide range of parts, e.g. nozzles, valves, and pump components or on certain structurally superior materials, e.g. nickel, cobalt, chromium or iron matrix refractory metal carbide structures. Such coatings would be a major advance in the art of environment resistant equipment, and a highly significant breakthrough in such formed articles as choke valves in oil field equipment.

Recently, an attempt has been made to have the desirable properties of titanium diboride available on refractory metal carbides. The route chosen however, was chemical vapor deposition, with the result that in addition to all the problems inherent in vapor deposition, e.g. holidays, variable coverage, inability to cover complex shapes, extensive efforts and processing are required to attempt to hold the titanium diboride on the article surface, and prevent spalling. The problem is that forming titanium diboride at the article surface gives erosion and abrasion resistance no better than the adhesion of the coating to the substrate, regardless of the intrinsic hardness of the titanium diboride.

In U.S. Pat. No. 4,268,582 to Hale et al, tungsten carbide articles are subjected first to a chemical vapor deposition of boron, then a boron diffusion, followed by a chemical vapor co-deposition of boron and titanium to form a titanium diboride superstrate on the boron predifused substrate, the substrate being expected to hold the superstrate on. Hale et al suggest that their result of a distinct superstrate coating of titanium diboride can be realized as well with molten salt bath deposition, pack diffusion and coating, and physical vapor deposition. However obtained, the coating approach to imparting the benefits of titanium diboride may be prone to the spalling failures which characterize all hard coatings not integrated with their surfaces, but only adhered thereto.

DESCRIPTION OF THE INVENTION

It is therefore among the objects of the invention to provide an integrally-added surface on refractory metal carbides, comprising a number of alloys including predominantly titanium diboride, to obtain the very hard, abrasion and erosion resistant properties of titanium diboride without the spalling prpoensities of the prior art. Other objects include the provision of articles such as choke valve, valve plugs and seats, and drill bits, and like formed articles having in replacement of their original surfaces of refractory metal carbide, and supporting matrix, a new surface supplanting, integrating, and incorporating the original surface, and comprised of titanium diboride, binder metal boride and refractory metal boride. No mere superstrate coating, the new surfaces imparted by the methods of the invention are integrated with the underlying carbide structure in a manner ensuring their removal only by eventually wearing down in use.

Other objects include titanium reaction decomposition of the refractory metal carbide at the treated surface into a single phase, soultion-type alloy comprising the refractory metal, the binder metal, and titanium; and, reconstruction of the surface by the formation of multiphase alloys of boron from such single phase alloys, by diffusion of boron thereino to form compounds including titanium diboride, and refractory metal borides, on the surfaces of articles of widely varying shape and composition.

These and other objects of the invention to become apparent hereinafter, are realized in accordance therewith in a formed article comprising a refractory metal carbide, the article having an added very hard, highly abrasion and erosion resistant surface inwardly and outwardly of the locus of the article original surface, the added surface consisting essentially of the reaction products of boron with the decomposition reaction products with titanium of the article surface refractory metal carbide. Typically, the refractory metal carbide is tungsten carbide, but the refractory metal can be as well as tungsten, tantalum, titanium or zirconium.

It is characteristic of the invention products that the added surface incorporates the article original surface, and consists essentially of a multiphase alloy comprising borides of the refractory metal and of titanium.

In particular embodiments, the formed article also includes boron inwardly of the added surface in the refractory metal carbide.

In a preferred embodiment, the invention provides a formed article comprising a refractory metal carbide, and a binder metal therefor, the article having an added very hard, highly abrasion and erosion resistant surface inwardly and outwardly of the article original surface, the added surface consisting essentially of the reaction products of boron with the binder metal and with the decomposition reaction products with titanium of the article surface refractory metal carbide.

As in the previous embodiments: the refractory metal carbide is typically tungsten carbide, although refractory metal carbides in which the refractory metal is tungsten, tantalum, titanium or zirconium can be used; the formed article added surface incorporates the article original surface, and consists essentially of a multiphase alloy comprising borides of the binder metal, of the refractory metal and of titanium; and there is boron inwardly of the added surface in the refractory metal carbide.

In addition, typically, the formed article utilizes a refractory metal carbide having a matrix of a binder metal, e.g. a binder metal which comprises cobalt, nickel, chromium or iron in refractory metal carbide-binding amount, such as in an article in which the refractory metal carbide comprises tungsten carbide, the binder metal is present in an amount between about 1.5% and 30% by weight.

In such articles, the added surface comprises a multiphase alloy of boron with the binder metal, titanium and tungsten, and has a depth of 0.1 to 1.5 mils, the locus of the article original surface lying within the added surface. Further, as in other embodiments, this last embodiment can have a layer of boron alloy with the binder metal lying under the added surface, the balance of the article being preferably tungsten carbide and cobalt or nickel binder.

As will be apparent from the foregoing, the invention provides formed articles in which the article defines locally a particulate fluid impingement area in a choke or valve seat and plug assembly, the fluid impingement area having the added surface formed thereon in particulate fluid erosion resisting relation.

For the purpose of making the formed articles described, the invention further includes the method for the fabrication of very hard, abrasion and erosion resistant surfaces on refractory metal carbide structures, which includes surface decomposing the refractory metal carbide by reaction with titanium and reacting the decomposition products and titanium with boron to form the surface.

In particular aspects, the method includes: destroying the original structure surface and forming in substitution therefor a single phase alloy in the refractory metal carbide structure, the alloy comprising titanium, carbon and the refractory metal; also reacting the components of the single phase alloy with boron in multiphase alloy-producing relation; and reacting boron with the refractory metal carbide structure below the single phase alloy.

In particular, there is provided method for the fabrication of very hard, abrasion and erosion resistant added surfaces on refractory metal carbide structure comprising tungsten, tantalum, titanium or zirconium carbide and an effective amount of a binder metal comprising cobalt, nickel, chromium or iron, which includes surface decomposing the refractory metal carbide to dissociate the refractory metal and the carbon by reaction thereof with titanium, and thereafter reacting the decomposition products comprising the refractory metal and the binder metal with titanium and boron to form the added surface.

The method further includes: diffusing boron from a diffusion pack into the surface decomposed refractory metal carbide structure, in boriding relation; diffusing the boron beyond the structure decomposed surface to form subsurface borides of the binder metal below the surface, the subsurface borides being of a hardness approximating the refractory metal carbides, whereby the surface is uniformly supported against particulate-laden fluid impingement; diffusing titanium from a diffusion pack to form a single phase alloy in the refractory metal carbide structure, the alloy comprising titanium, carbon, the binder metal, and the refractory metal; reacting the components of the single phase alloy with the diffused boron in multiphase alloy producing relation; and employing a refractory metal carbide structure comprising tungsten carbide and a metal binder comprising cobalt or nickel as the structure.

In a particularly preferred embodiment of the invention method of forming very hard, abrasion and erosion resistant surfaces on tungsten carbide surfaces, there is included exposing the tungsten carbide and cobalt or nickel binder structure at the surface to be treated to a titanium diffusion pack and diffusing titanium into the structure surface for a time, at a temperature and in an amount obliterating the structure surface and decomposing the surface tungsten carbide into a single phase alloy comprising tungsten, titanium, cobalt or nickel respectively, and carbon; diffusing boron into the single phase alloy under reaction conditions to form a substitute structure surface comprising multiphase alloy of boron with titanium, cobalt or nickel respectively, and tungsten; and continuing boron diffusion to pass boron below the boride alloy system for forming borides with the cobalt or nickel structure binder.

Thus, in acordance with the invention there is provided a method of forming very hard, abrasion and erosion resistant surfaces on tungsten carbide and cobalt or nickel binder structures such as chokes, valve assemblies, plugs, seats and like structures to be subjected to high pressure particulate-laden fluids in use, which includes in sequence diffusing into the structure titanium from a titanium diffusion pack comprising from about 10% by weight titanium, up to about 90% by weight refractory, and a small but effective amount of halide carrier to decompose the tungsten carbide in the region of diffusion and to form a single phase titanium, tungsten, binder and carbon-containing solution-type alloy, and diffusing boron from a boron diffusion pack comprising up to about 100% by weight boron, and a small but effective amount of a halide carrier into the titanium containing single phase alloy for a time and at a temperature sufficient to form a continuous titanium diboride, tungsten boride, and tungsten titanium boride containing alloy system on the structure as an added surface.

In such method it is preferred to employ about 10 to about 30% titanium, about 30 to about 90% aluminum oxide, and less than about 1% halide carrier in the titanium diffusion pack; to effect titanium diffusion for not less than about 2 hours and at not less than about 1800° F.; to effect boron diffusion for not less than about 2 hours and at not less than about 1700° F.; to employ about 10 to about 30% titanium, about 30 to about 90% aluminum oxide, and less than about 1% halide carrier in the titanium diffusion pack; to effect boron diffusion from a refractory containing pack having at least 3% boron for not less than about 2 hours and at not less than about 1700° F.; to employ aluminum oxide as the refractory and less than about 1% halide carrier in the boron diffusion pack.

In general, titanium comprises from about 15% to 45% by weight of the multiphase boride alloy system, and boron comprises from about 5% to 50% by weight of the multiphase boride alloy system, each based on the total weight of the alloy system.

Preferably, the formed article comprises tungsten carbide and a cobalt, nickel or nickel/cobalt binder, the binder being present in an amount less than about 20% by weight based on the weight of tungsten carbide Such binder may be alloyed with boron below the multiphase alloy to increase binder hardness to about the hardness of the tungsten carbide.

The formed article based on tungsten carbide structure having a cobalt binder, in general has a surface comprising in cross-section a surface layer inward and outward of the locus of the original article surface, and incorporating that locus, comprising titanium diboride, tungsten boride, cobalt boride, and cobalt-titanium-tungsten-borides, and a further relatively more inward layer comprising tungsten carbide and cobalt borides all atop the tungsten carbide and binder article body.

PREFERRED MODES

The terms "structure" and "formed article" herein refer to products of manufacture, or a portion thereof which are cast, sintered, forged, or otherwise shaped from a mass of refractory metal carbide, in whole or in part, as a separate entity or upon or in a base product of the same or dissimilar material.

"Refractory metal carbide" herein refers to carbides of tungsten, tantalum, titanium and zirconium, and the like. Typically, and herein, such carbides can comprise in addtion to the carbide a binder, e.g. in from 1.5 to 30% by weight concentration, based on the weight of the carbide and binder taken together, for the purpose of holding particulate carbides together. Suitable binder metals are cobalt, nickel, chromium and iron, and combinations thereof with each other.

The invention enables the obtaining of highly wear resistant, very hard coatings on parts of even complex configuration by virtue of the use of diffusion pack technology. Diffusion packs are used to surround the part to be coated, and heat is applied at high temperatures for extended periods whereby the part surface is diffused with the pack elements forming a diffusion coating. In contrast to chemical vapor deposition technology wherein reagents are flowed past the surface being treated and their effectiveness is dependent on adequacy of flow over all the parts to be treated despite surface changes, bosses, openings, and internal ribs all of which adversely affect fluid flow coverage in chemical vapor deposition.

However, as taught herein titanium or boron metal to be diffused into the part structure to be given a coating is intermixed with an inert diluent, typically a refractory such as aluminum oxide, zirconia, magnesia and like polyvalent metal oxides in highly powdered form, e.g. less than 50 U.S. Mesh. This enables intimate, positive contact of the treating diffusant, e.g. titanium or boron, as appropriate, with all parts, including blind recesses, of the article to be resurfaced, unlike chemical vapor deposition.

The diffusion is carried out in the absence of air to have a nonoxidizing and nonreactive environment in the pack and particularly at the interface of the pack and the part structure surface. Typically, diffusion is aided by the presence of an activator or carrier, typically a halide compound present in small amounts, e.g. less than 1% of a halogen or halogen precursor compound, such as iodine, bromine, chlorine and fluorine, per se and their salts such as alkali metal, alkaline earth metal and ammonia salts from which the halogen is readily releasable.

The pack is suitably conditioned and then heating of the pack in contact with the part effected, generally for 2 to 18 hours at temperatures from about 1300° F. to less than about 2100° F., depending on the part at hand, the diffusion of boron or titanium, the particle size of the pack, its composition and other factors known to those skilled in the diffusion coating art which determine the interdiffusion rate and depth. Because the present invention is applicable to the formation of super hard coatings on both very thin and very thick cross section structures, generalizing across the spectrum of different structures in terms of temperature and times of diffusion is necessarily presented only in broad, benchmark terms. Thus, diffusion depths., for example, while typically 2 to 4 mils, may be greater, up to - mils, or more, or less, particularly where foils are being coated, e.g. down to as little as 0.2 mil.

In the present invention it is preferred to effect a titanium diffusion from a pack, although a surface coat of titanium, sprayed, plated, or otherwise applied, preceded or followed by the boron diffusion from a pack may be used.

Titanium diboride formation is the predominant reaction and occurs in the surface layer under boron diffusing conditions, so that titanium diboride forming conditions include heating the part previously surface enriched with titanium in contact with boron metal in a diffusion pack, in a nonoxidizing and nonreactive environment (i.e., a closed pack vessel). Inspection of the obtained part reveals a substantially continuous layer, parallel with and substantially defining the part structure surface of titanium diboride, i.e. extending in laterally two dimensions in its particular thickness. Microscans reveal a generally planar layer which follows the contour of the part surface, and which is substantially free of holidays so as to be continuous across its length and breadth. It has been found that boron continues to diffuse through the titanium diboride layer, forming borides of the binder metal, e.g. cobalt or nickel borides. This phenomenon is surprising and highly beneficial in that cobalt boride has a hardness similar to tungsten carbide, whereby the surface complex of boron alloys is supported more uniformly, either by the matrix cobalt borides or by the tungsten carbides, both being of like hardness. In the absence of the boron perfusion and cobalt boride formation, the matrix portions of the tungsten carbide structure are substantially less hard than the carbide and uneven support of the surface results in the face of particulate impingements.

Example 1

A tungsten carbide, cobalt binder matrix structure containing 6% cobalt, was treated for 10 hours at 1800° F. in a pack comprised of about 30% titanium powder, about 70% aluminum oxide powder, and 0.08% ammonium bifluoride. After time at temperature, the structure was allowed to cool, and then was placed in a second pack composition of about 5% boron, about 95% aluminum oxide and again about 0.08% ammonium bifluoride. The surface of tungsten carbide has been consumed and the carbon and tungsten separated by reaction with the titanium and put in a solution-type alloy having a single phase. The surface extended inward and outward from the locus of the original structure surface.

The second pack was then heated to about 1700° F. for 10 hours. Inspection of the structure revealed a continuous multiphase alloy surface coating of titanium diboride, cobalt boride, and tungsten-titanium boride of about 0.2–0.3 mil depth, and a boron subsurface diffusion to a total depth of about 2 mils.

The structure was tested for wear resistance by running on a lapping machine with diamond dust abrasive. A CONTROL structure, identical except for the coating, was also run on the lapping machine under the same conditions. The structure having the coating in accordance with the invention had a rate of material removal only one-fourth that of the uncoated CONTROL.

Example 2

A first set of cobalt/tungsten carbide let-down valve parts used in coal slurry service operating under extreme conditions of heavy erosion was evaluated against a second, uncoated set of the let-down valve parts, identical except for that a multiphase alloy diffusion coating hereof was applied to the first set, but not the second. The use-life of the coated parts was found to be twelve times that of the uncoated, control parts.

We claim:

1. A formed article comprising a refractory metal carbide, said article having a very hard, highly abrasion and erosion resistant surface inwardly and outwardly of the locus of the article original surface, said surface consisting essentially of the reaction products of boron with titanium and the decomposition reaction products of titanium with the article surface refractory metal carbide.

2. A formed article comprising a refractory metal carbide, and a binder metal therefor, said article having an added very hard, highly abrasion and erosion resistant surface inwardly and outwardly of the article original surface, said added surface consisting essentially of the reaction products of boron with titanium and said binder metal and the decomposition reaction products of titanium with the article surface refractory metal carbide.

3. A formed article comprising a carbide of a refractory metal and a binder metal, said article having a surface region in which said carbide has been decomposed into its carbon and refractory metal constituents by reaction with titanium, said constituents and said titanium having been thereafter reacted with boron to form borides of said refractory metal, said binder metal and said titanium, said borides constituting said surface region.

4. The article according to claim 3, in which said refractory metal carbide is tungsten carbide.

5. The article according to claim 3, in which said refractory metal constituent is tungsten, tantalum, titanium or zirconium.

6. The article according to claim 3, in which said binder metal comprises cobalt, nickel, chromium, or iron in an amounts sufficient to bind said refractory metal carbide.

7. The article according to claim 3, in which a layer of boron alloy with said binder metal underlies said surface region.

8. The article according to claim 3, in which said binder metal is present in an amount between 1.5% and 30% by weight.

9. The article according to claim 8, in which said refractory metal carbide is tungsten carbide.

10. The article according to claim 9, in which said refractory metal constituent is tungsten, tantalum, titanium or zirconium.

11. The article according to claim 10, in which said binder metal comprises cobalt, nickel, chromium, or iron.

12. The article according to claim 11, in which a layer of boron alloy with said binder metal underlies said surface region.

* * * * *